US006395191B1

(12) United States Patent
Schell

(10) Patent No.: US 6,395,191 B1
(45) Date of Patent: May 28, 2002

(54) METHOD FOR PROTECTING A PAPER SECURITY DOCUMENT OR IDENTIFICATION DOCUMENT

(75) Inventor: Karel Johan Schell, Noordwijk (NL)

(73) Assignee: Lean B.V., Noordwijk (NL)

( * ) Notice: Subject to any disclaimer, the term of this patent is extended or adjusted under 35 U.S.C. 154(b) by 0 days.

(21) Appl. No.: 09/230,104

(22) PCT Filed: Jul. 9, 1997

(86) PCT No.: PCT/NL97/00401

§ 371 (c)(1),
(2), (4) Date: Jan. 22, 1999

(87) PCT Pub. No.: WO98/03348

PCT Pub. Date: Jan. 29, 1998

(30) Foreign Application Priority Data

Jul. 23, 1996 (NL) ..... 1003663

(51) Int. Cl.[7] ..... B44C 1/22

(52) U.S. Cl. ..... 216/65; 264/400; 219/121.6; 902/7; 283/57; 283/58

(58) Field of Search ..... 216/65; 264/400; 219/121.6; 194/206; 902/7; 359/2; 283/57, 58

(56) References Cited

U.S. PATENT DOCUMENTS

| | | | | | |
|---|---|---|---|---|---|
| 4,740,269 | A | * | 4/1988 | Berger et al. | 216/65 |
| 4,943,093 | A | * | 7/1990 | Melling et al. | 283/83 |
| 5,284,364 | A | * | 2/1994 | Jain | 283/87 |
| 5,324,200 | A | * | 6/1994 | Vassiliadis et al. | 433/224 |
| 5,630,979 | A | * | 5/1997 | Welz et al. | 264/400 |

FOREIGN PATENT DOCUMENTS

| | | | | |
|---|---|---|---|---|
| DE | 36 34 098 | | 4/1987 | |
| DE | 43 34 847 | | 4/1995 | |
| EP | 0 388 090 | | 9/1990 | |
| EP | 0388090 | * | 9/1990 | B24D/15/00 |
| WO | WO 95/26274 | | 10/1995 | |

* cited by examiner

*Primary Examiner*—Randy Gulakowski
*Assistant Examiner*—Shamim Ahmed
(74) *Attorney, Agent, or Firm*—Handal & Morofsky

(57) ABSTRACT

In order to protect a paper-thin valuable document or identification document on which an identification mark has been placed, for example by means of a printing technique or by a laser technique, in such a way that counterfeiting is extremely difficult, at least part of said identification mark is repeated at another point by changing the thickness of the document locally. At least part of the identification mark is thus clearly liked to the paper substrate.

13 Claims, 1 Drawing Sheet

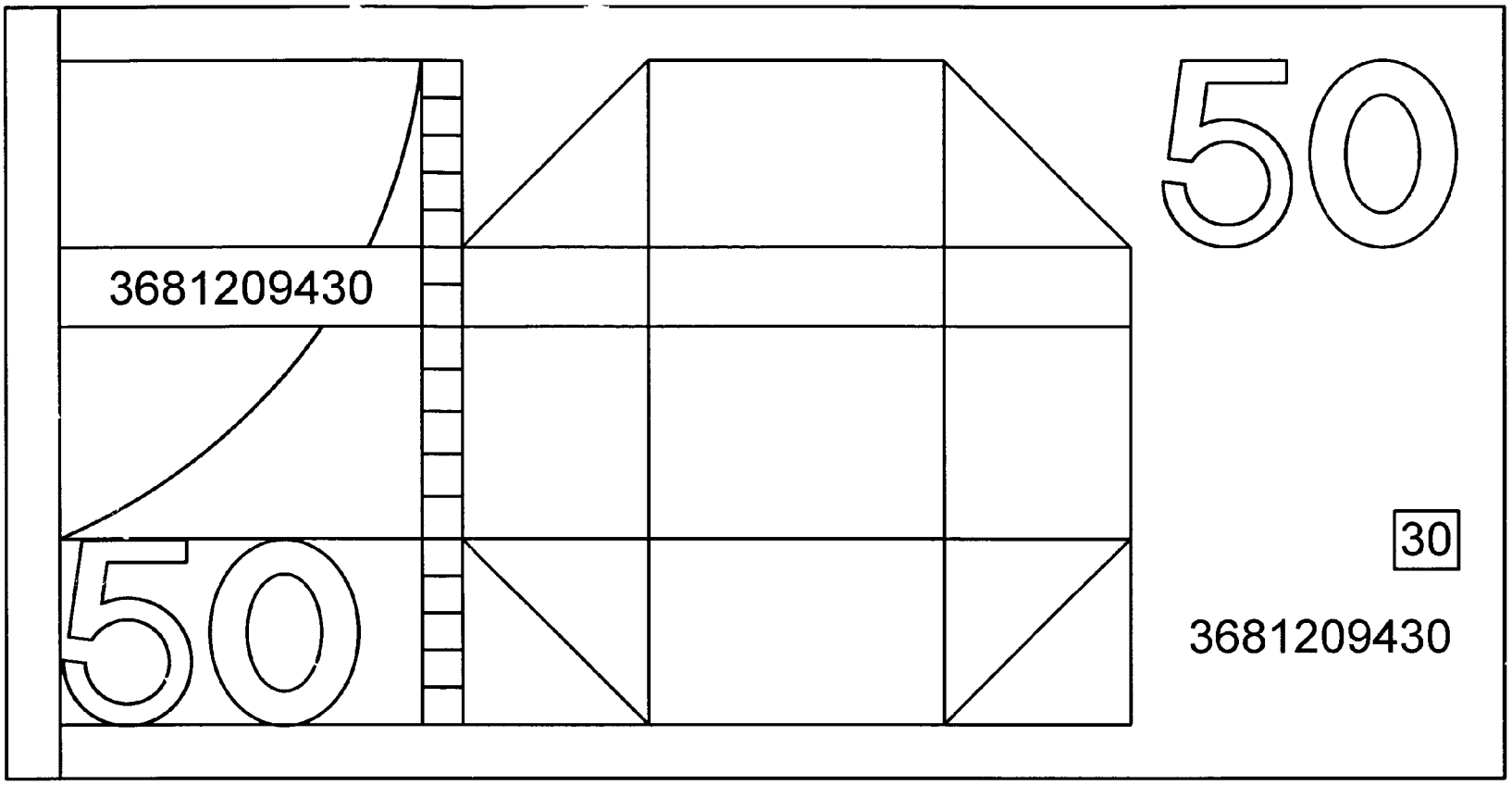
50
30
3681209430
3681209430
50

METHOD FOR PROTECTING A PAPER SECURITY DOCUMENT OR IDENTIFICATION DOCUMENT

The invention relates to a method for protecting a bank-note or identification document on which a number is placed identifying the individual bank-note or identification document.

The fact that all kinds of copying techniques have become available to the public, means that it is becoming increasingly important to protect bank-notes and documents permitting the identification of persons. Counterfeiting must become increasingly difficult, and protection must always be ahead of the equipment available to the counterfeiter. Bank-notes and passports or other identification documents always have a number by means of which they can be recognized as unique notes or documents.

The object of the invention is to provide a method of the type mentioned in the preamble which leads to bank-notes or identification documents whose abovementioned unique number, or part thereof, is very difficult to counterfeit.

According to the invention, the method referred to in the preamble is characterized in that at least a part of said number is repeated at another place of the bank-note or identification document by reducing the thickness of the document locally by means of laser etching.

Laser etching, which is carried out by local removal of, for example, slightly less than half the thickness of the paper or plastic, clearly links the identification number or part thereof to the paper substrate. By local thinning of the paper or paper-thin plastic, security which is linked to the identification number is provided.

No hologram, film or kinogram image is therefore added, but only substrate material is removed to a certain depth.

As a consequence of laser etching the part of the document having the locally reduced thickness, gets a brown colour, most likely caused by the fact that the energy rich laser beam burns the substrate a little bit. The brown coloured marks, which are dark with respect to the surrounding substrate, do not have the appearance of a water mark. Comparing the printed marks with the repeated marks becomes difficult.

By exposing the part of the document on which the repeated part of the identification number has been placed, to bleaching or decolouring, the brown colour vanishes. A pre-treatment with a bleaching or decolouring agent, for instance by an impregnated pad, may take place immediately after the laser etching.

Oxidizing bleaching agents are for instance peroxides, hypochlorides, persalts such as potassium permanganate ($KNMO_4$), potassium persulphate ($K_2S_2O_8$), sodium perborate ($Na_2BO_3$), sodium percarbonate ($Na_2CO_4$) and ozone ($O_3$). It is not excluded that the substrate itself comprises an oxidizing bleaching agent, in which case the treatment with a bleaching agent immediately after the laser edging can be omitted.

The invention also relates to a bank-note or other identification document on which an identification number has been placed, at least part of which is repeated by means of the abovementioned method.

EP-A-0388090 discloses a bank-note or such like security document having a look through figure provided in a region of the bank-note having a substantial uniform transparency which is more transparent than a majority of the remainder of the bank-note. On the back of the bank-note a solid figurine is printed in register with said look-through figure. Another solid figurine is printed elsewhere on the bank-note. There is no indication that a part of the individual bank-note number is repeated at another place of the bank-note by reducing thickness of the document by means of laser etching.

DE-A-3634098 relates to a method for making trueness features on bank-notes or the like by laser etching. The trueness features on all the bank-notes are the same and there is no talk of repeating at least part of the individual bank-note number at another place of the bank-notes.

The invention will now be explained further with reference to the FIGURE. This FIGURE shows a copy of a bank-note, on a slightly enlarged scale.

It can be seen in the FIGURE that on the lower right-hand side the unique identification number 3681209430 is produced on the paper of the bank-note by means of a printing technique the last two digits, 30, which are known by the term "check digit", are repeated at another point on the bank-note by removing the paper over part of the paper thickness, preferably no more than half the paper thickness, by laser etching. Therefore, by local thinning, additional protection which is linked to the existing mark is achieved. This local thinning constitutes an extremely great complication for a counterfeiter. The protection against counterfeiting has therefore been greatly improved by a simple trick. Instead of being made of paper, the bank-note or the document can be made of plastic with the thickness and flexibility of paper.

Furthermore, it is quite possible for the identification number concerned to be applied by laser etching all the way through the paper, instead of by printing.

What is claimed is:

1. Method for protecting a banknote or identification document bearing an individual identifying number in a first location, the method comprising laser etching a second location on the banknote or identification document to reduce the thickness of the banknote or identification document locally, wherein at least a part of the individual identification number is provided at said second location by said laser etching.

2. Method according to claim 1, wherein the second location is exposed to bleaching or decoloring after laser etching.

3. Method according to claim 1, applied to protecting a banknote, the identification number on the banknote being the banknote number, wherein the at least a part of the banknote number is the check digit of the bank-note number.

4. A banknote or identification document produced by a method according to claim 1.

5. Method according to claim 2, applied to protecting a banknote, the identification number on the banknote being the banknote number, wherein the at least a part of the banknote number is the check digit of the bank-note number, the check digit optionally being the last two digits of the banknote number.

6. Method according to claim 1 applied to a series of banknotes or identification documents for protection against counterfeiting, wherein the individual identification number is unique to the banknote or identification document bearing the identification number and wherein the portion of the identification number applied to the second location is a variable portion of the identification number.

7. A method for producing serialized documents, each document bearing a unique identifier in a first location on the document, the method comprising reducing the thickness of the document at a second location so as to define a security mark for protection against counterfeiting, the security mark being logically linked with the unique identifier.

8. A method according to claim 7, wherein the second location is exposed to bleaching or decoloring after laser etching.

9. A method according to claim 7, wherein the serialized documents are banknotes, the unique identifier being the banknote number and wherein the security mark is at least a part of the banknote number.

10. A method according to claim 9 wherein the at least a part of the banknote number is a check digit for the bank-note number, the check digit optionally being the last two digits of the bank-note number.

11. Method according to claim 7 wherein the security mark is a variable portion of the identification number.

12. A document produced by a method according to claim 7.

13. A method according to claim 7 comprising employing laser etching to reduce the thickness of the document at the second location, the laser-etched thickness reduction being patterned to provide the security mark.

* * * * *